US005660064A

United States Patent [19]

Ecker et al.

[11] Patent Number: 5,660,064

[45] Date of Patent: Aug. 26, 1997

[54] DOUBLE-LOCKING MECHANISM FOR HANDCUFFS

[76] Inventors: Robert J. Ecker, 128 Carriage Rd., Chicopee, Mass. 01013; Paul W. Koetsch, 43 Treetop Ave., Springfield, Mass. 01118

[21] Appl. No.: 493,560

[22] Filed: Jun. 22, 1995

[51] Int. Cl.[6] ..... E05B 75/00

[52] U.S. Cl. ..... 70/16; 70/14

[58] Field of Search ..... 70/14–19

[56] References Cited

U.S. PATENT DOCUMENTS

| | | | |
|---|---|---|---|
| 222,751 | 12/1879 | Kahlke | 70/16 |
| 1,161,562 | 11/1915 | Wesson | 70/18 |
| 1,252,517 | 1/1918 | Walden | 70/16 |
| 1,531,451 | 3/1925 | Neal . | |
| 1,851,206 | 3/1932 | Neal . | |
| 1,855,687 | 4/1932 | Neal . | |
| 1,872,857 | 8/1932 | Wesson . | |
| 1,900,242 | 3/1933 | Latov | 70/16 |
| 2,390,885 | 12/1945 | Kelley . | |
| 2,759,349 | 8/1956 | McKee | 70/16 |
| 4,287,731 | 9/1981 | Kruger . | |
| 4,314,466 | 2/1982 | Harris . | |
| 4,509,346 | 4/1985 | Szczenpanek . | |
| 4,574,600 | 3/1986 | Moffett . | |
| 4,694,666 | 9/1987 | Bellingham | 70/16 |
| 4,697,441 | 10/1987 | Allen | 70/14 |
| 5,138,852 | 8/1992 | Corcoran . | |

FOREIGN PATENT DOCUMENTS

| | | |
|---|---|---|
| 372619 | 5/1932 | United Kingdom . |
| 583610 | 12/1946 | United Kingdom . |

*Primary Examiner*—Steven N. Meyers
*Assistant Examiner*—Gary Estremsky
*Attorney, Agent, or Firm*—Donald S. Holland, Esq.; Holland & Bonzagni, P.

[57] ABSTRACT

An improved double-locking mechanism for handcuffs is disclosed. In the preferred embodiments, a standard pawl and multi-piece slide-bolt assembly have been modified to prevent premature sliding of the bolt into its "double-locking" position, and to prevent dislodging of the bolt back into its "non-locking" position. The unique slide bolt, or the nearby lock casing, is angularly offset to create a fulcrum. The bolt also has an underlying tab that is designed to rest in either of two side-by-side locator notches atop a cuff's pawl. One notch firmly locates the bolt in a double-locking position, while the other notch normally keeps it in a non-locking position. To shift the bolt into its double-locking position, an authorized user presses any suitable actuator (e.g., the tiny end of a handcuff key or a ball-point pen end) against an exposed inclined end of the bolt. This pivots the bolt about the fulcrum and against the casing, so that it lifts the tab out of the non-locking locator notch. Continued pressure by the actuator forces the bolt to slide over a ledge that separates the notches. Once the tab rides past the ledge, it re-pivots into the double-locking position. A spring action holds the tab (and bolt) in place until a user forcefully retracts the bolt when unlocking the cuffs.

14 Claims, 2 Drawing Sheets

DOUBLE-LOCKING MECHANISM FOR HANDCUFFS

BACKGROUND OF THE INVENTION

This invention relates to shackles and more particularly to handcuffs, and leg irons, with double-locking mechanisms.

Handcuffs, such as those shown in U.S. Pat. No. 2,390,885 to Kelley, typically have a pair of arcuate frame parts, known as a jaw and cheek, that are pivotally coupled to one another. A pawl-and-ratchet mechanism permits one-way rotational movement of the jaw as it pivots through the spaced apart arms or plates that form the cheek. Teeth on the pawl's underside ride over complimentary ratchet teeth in the top of the jaw, as the jaw rotates into the cheek, to lock the cuff around a person's wrist. Spring pressure atop the pawl is meant to prevent the jaw from backing off and unlocking the cuff.

As described in the aforementioned patent to Kelley (assigned to the Peerless Handcuff Company), skilled lock pickers could open old-fashioned cuffs by lifting the pawl and sliding out the unencumbered jaw. Kelley therefore added a slide bolt that overlay the pawl, inside the frame. When a tiny key end (element No. 9 in Kelley's drawings) was pushed into a side channel of the frame, a separate drift pin (carried in the channel) moved against an end of the bolt. Continued pressure caused the bolt to slide so that an interference surface on it would then abut the pawl. This surface blocked the pawl to prevent it from being lifted; and it would hopefully remain in place until the authorized user inserted the key's other, main end to unlock the cuff.

This "slide-bolt" assembly acted as a "double lock". Not only did the bolt prevent the jaw from being picked open, it also acted to prevent overtightening of the cuff. Overtightening used to occur after a jaw and cheek were initially coupled properly about a wearer's wrist. If the outside of the cuff's jaw was accidentally struck, it could pivot further under the pawl. The result was often painful, and cut off blood flow in the wearer's hand. But, with the bolt, the pawl could be kept in place, so that the jaw could not move in either rotational direction.

While Kelley's slide bolt assembly was an improvement, its bolt sometimes slipped into place prematurely. That would block the cuff's jaw and cheek from locking together initially. That type of flaw is exasperating to police, who rightfully expect a cuff to operate. They do not want to fumble with a cuff when they are trying to subdue a dangerous felon.

Slide bolts have therefore been modified, such as to that disclosed in U.S. Pat. No. 4,509,346 to Szczepanek, assigned to Universal Tool Company, Inc. That patented structure is shown as "Prior Art" in this application's FIG. 2. As described in the Abstract of Szczepanek's patent. "The unintentional movement of the bolt into its double-locking position is prevented by providing a restraining means—a spring loaded pin [element No. 27 in the patent's drawings] —that operates against the casing and the bolt to resiliently urge the bolt against the latch and against the spreading of the action of mating shoulders [24, 25] on the bolt and latch that cause the two to spread apart against the action of the restraining means as the bolt moves forward toward the double-locking position and the shoulders engage." While the patent purports that this structure also prevents unintentional dislodging of the bolt from its locking position, it is relatively ineffective in that regard. By smashing the side of the cuff against a hard surface, the slide bolt can become dislodged, whereupon it automatically retracts to its original position, due to the spring force caused by the spring 27 adjacent the drift pin.

There is also another drawback with prior slide-bolt assemblies: They utilize a separate drift pin, like the one shown in Szczepanek, to push the slide bolt into its double-locking position. Sometimes, the pin seizes or breaks. A user is then frustrated because the assembly does not work.

It is therefore a primary object of the present invention to provide an improved double-locking mechanism for handcuffs (and leg irons) that overcomes the problems of the prior art.

It is another general object to provide an improved double-locking mechanism that avoids premature actuation or dislodging.

It is still another object to provide such a double-locking mechanism, with a unitary slide bolt, that is less susceptible to failure or breakage.

It is a further object to provide an improved double-locking mechanism that is constructed to afford increased strength and more reliability in the field.

BRIEF DESCRIPTION OF THE DRAWINGS

FIGS. 3–5 are enlarged action views of the "Double-Locking Mechanism" of FIG. 1, wherein:

FIG. 3 shows a unitary slide bolt resting in its non-locking position;

FIG. 4 shows the bolt being pushed to the left, midway between its non-locking and double-locking positions; and FIG. 5 shows the bolt resting in its double-locking position.

SUMMARY OF THE INVENTION

Figure 3:
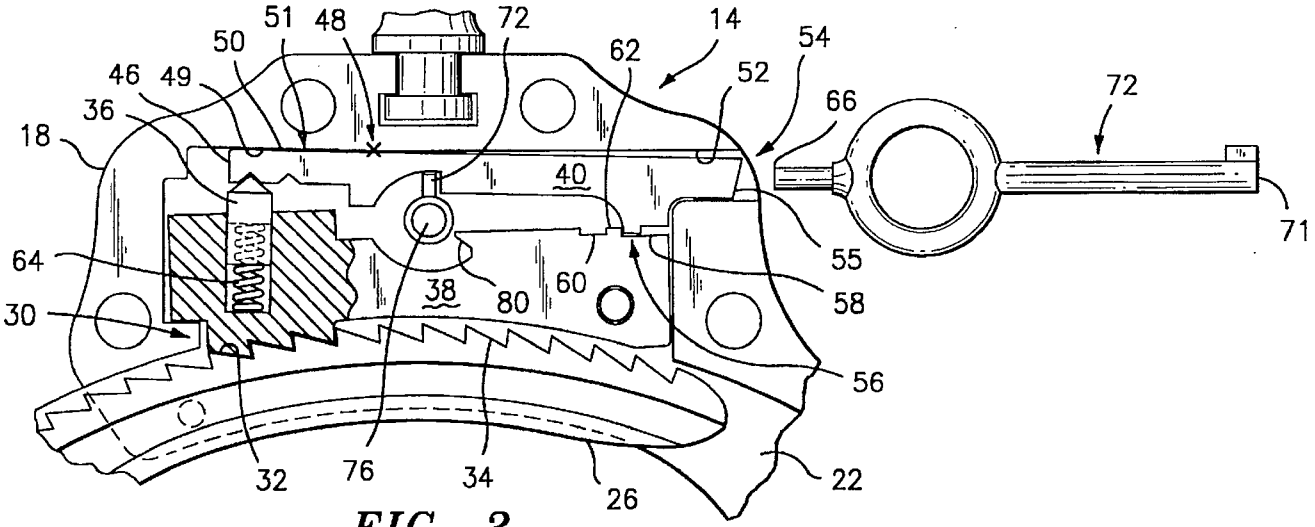
Figure 5:
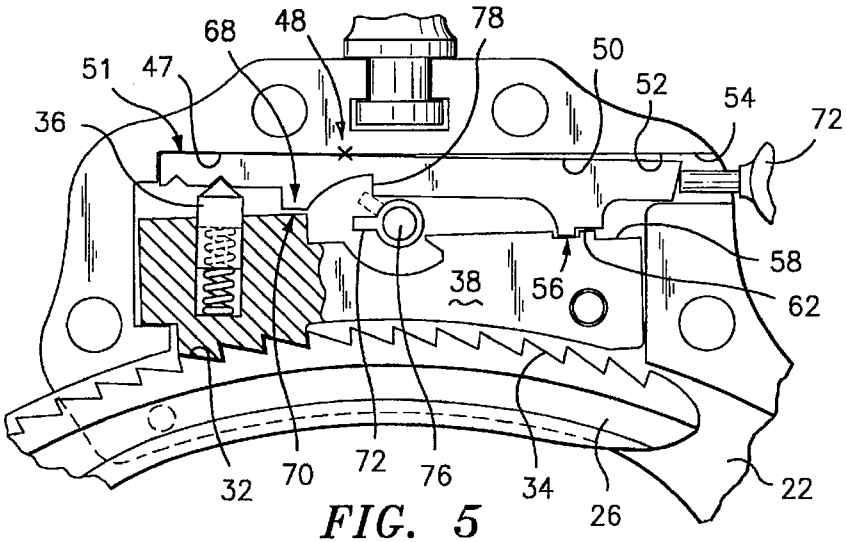
Figure 4:
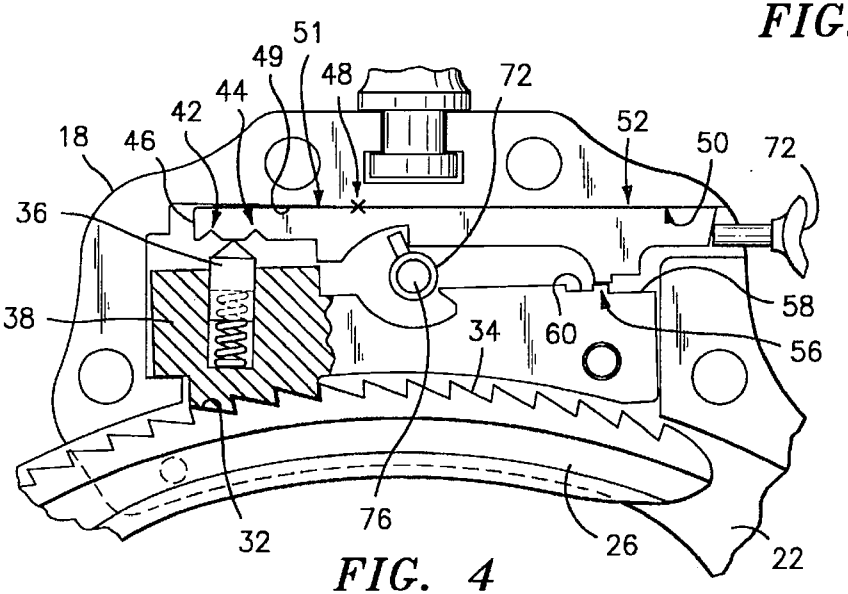

An improved mechanism to "double-lock" handcuffs is disclosed. In the preferred embodiments, the invention comprises modified versions of the standard pawl and slide bolt found inside the lock casings of modern cuffs. Either the "top" surface of the bolt, or the nearby surface of the lock casing instead, has an offset or canted portion. This creates a fulcrum about which the bolt can be pivoted against the casing. In either, the bolt has a tab on its "bottom" surface that is designed to firmly rest in either of two notches atop the pawl, wherein one of the notches locates the bolt in a maintained "non-locking" position and the other maintains it in a "double-locking" position. By inserting a tiny key end or other suitable device (e.g., a ball-point pen end) against an exposed inclined end of the bolt (through a channel in the lock casing), the key end cooperates with the inclined end to pivot the bolt about the fulcrum and lift the tab out of the "non-locking" locating notch. Continued pressure with the key slides the bolt to the left (as shown in FIGS. 3–5) until the tab falls into the second notch. This holds the bolt in its double-locking position, whereupon the cuffs cannot be picked open nor overtightened. Due to the strength of this detent arrangement, the bolt is prevented from being dislodged, back to its non-locking position, until an authorized user decides to unlock the cuffs.

DETAILED DESCRIPTION OF THE PREFERRED EMBODIMENTS

In FIGS. 1 and 3–5, Applicants have disclosed their most preferred embodiment of their improved "Double-Locking Mechanism for Handcuffs". It is generally designated by the reference numeral 10.

There are several types of double-locking cuffs, such as those disclosed in U.S. Pat. No. 2,390,885 to Kelley and U.S. Pat. No. 4,509,346 to Szczepanek (previously described in this application's "Background" section). These patents are hereby incorporated by reference.

As is common in handcuffs of this type, the complete shackle 10 is made up of a pair of handcuffs 12, 14 permanently linked together, by a chain 16 or hinge assembly (not shown). Each cuff (e.g., 14) has a U-shaped frame member or casing 18 that houses a locking mechanism; a pair of basically semi-circular, overlying plates 20, 22 that extend from the U-shaped member 18 to form a cheek 24; and a curved solid jaw or ratchet 26 that is pivotally connected to the bottom of the cheek plates (at 28). A pawl-and-ratchet mechanism 30 permits one-way rotational movement of the jaw 26 (clockwise in FIG. 2) as it pivots through the cheek 24. Teeth 32 on the pawl's underside (as viewed in FIG. 3) ride over complimentary teeth 34 in the top of jaw 26, as the jaw rotates into the cheek 24, to lock the cuff 14 around a person's wrist (not shown). Pressure from a spring-loaded detent pin 36 operates against the pawl 38 to prevent it from lifting off the jaw's teeth 34. This prevents the jaw 26 from backing off and prematurely unlocking the cuff 14.

Figure 2:
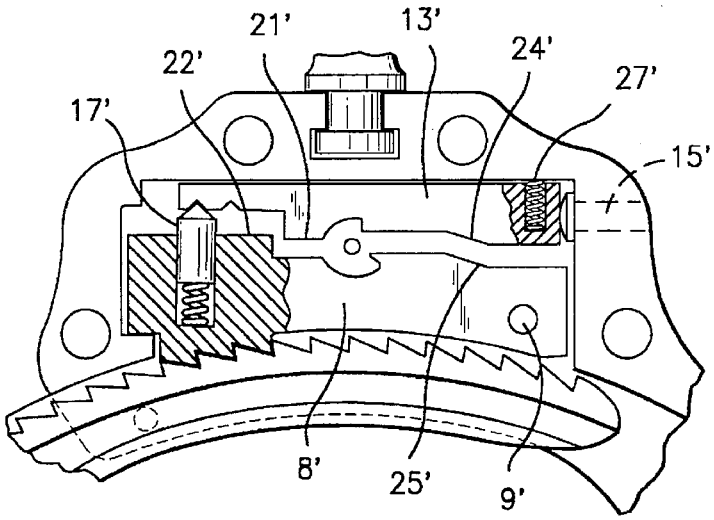
FIG. 2 (PRIOR ART)
FIG. 2 shows a "Prior Art" view of the double-locking assembly of U.S. Pat. No. 4,509,346 to Szczepanek.

As described in this application's "Background" section, various attempts have been made to provide "slide-bolt" assemblies that act as a "double lock"—to prevent the jaws from being picked open and to prevent overtightening of the cuffs. Szczepanek's attempt is shown in FIG. 2. For ease of comparison to the Szczepanek patent, Applicants have basically incorporated some reference numerals used in that patent in this application's FIG. 2. The only difference is that this application's rendition includes primes after those numbers to prevent any confusion with Applicants' improved structure.

In the present invention, Applicants have utilized mostly standard components of handcuffs—for example, the jaw and cheek plates. Elements in FIGS. 1, 3–5 have been numbered accordingly. It should be understood, however, that Applicants' most preferred embodiment utilizes a modified casing 18, pawl 38 and slide bolt 40.

As in the patents to Kelley and Szczepanek, slide bolt 40 has a pair of V-shaped notches 42, 44 (best shown in FIG. 4) near a first bolt end 46. Detent pin 36 sits in either V-notch 42, when the bolt 40 is in a non-locking position (see FIG. 3); or, pin 36 sits in V-notch 44, when the bolt 40 is in its "double-locking" position (see FIG. 5). Unlike the relationship between prior slide bolts and lock casings, like Szczepanek's in FIG. 2, Applicants' has a fulcrum 48 between the two.

In Applicants' most preferred embodiment (FIGS. 1, 3–5), there is a modified interior surface 49 of lock casing 18 that is closely adjacent the straight "top" or upper surface 50 of bolt 40. Starting near bolt end 46, casing surface 49 has an angularly offset or canted portion 51 that slopes downwardly, toward bolt 40. At fulcrum point 48, the casing surface levels off (see 52) and becomes horizontal or generally parallel to the holt's straight top surface 50. The amount of incline of canted portion 51 is sufficient to allow for some rocking or pivoting of the slide bolt about fulcrum 48, against the casing 18.

Applicants' slide bolt 40 also does not require the troublesome drift pin (found in the prior art) to operate. Instead, Applicants' slide bolt is a unitary piece 40 which has a narrowed or finger end portion 53 that projects through an open hole or side channel 54 of the cuff's casing 18. The exposed bolt end 55 is sloped downwardly to assist in pivoting the bolt 40.

The underside or "bottom" of bolt 40 (as viewed in FIGS. 3–5) has a squared tab 56 that is designed to rest in two side-by-side locator notches 58, 60 atop pawl 38. Notch 58 is deeper than notch 60, and they are separated by a ledge or shoulder 62.

FIGS. 3–5 show the operation of Applicant's double-locking mechanism 10. That action is described as set forth below.

FIG. 3 shows the bolt 40 in its non-locking position, where the pawl 38 is free to move up-and-down over the jaw's teeth so that the cuff can be coupled around a wearer's wrist. In the bolt's non-locking position, spring 64 has forced detent pin 38 into V-notch 42, causing bolt top 50 to pivot about fulcrum 48, against the canted casing surface 51. Tab 56 is rocked into locator notch 58, where it cooperates with ledge 62 to block any undesired leftward movement of bolt 40. The bolt is firmly held in this non-locking position, until the user decides to shift the bolt 40 into its double-locking position.

After the cuff has been coupled around a wearer's wrist, the authorized user (e.g., a policeman) pushes any suitable double-lock actuator, such as standard key end 66, against the exposed slope of bolt end 55. The actuator pushes against the inclined end to cause an upward lift on bolt 40. This rocks the straight top surface 50 of the bolt 40 about fulcrum 48, against the straight casing surface 52. During this rocking motion, the tab 56 is pivoted out of "non-locking" notch 58. Continued pressure by the actuator forces the bolt 40 to slide to the left, so that its tab rides over ledge 62 (see FIG. 4) and re-pivots into "double-locking" notch 60 (see FIG. 5).

While the slide bolt 40 is in its double-locking position shown in FIG. 5, its standard interference surface 68 abuts a locking surface 70 atop pawl 38. This locks the pawl and restricts its upward movement, thereby keeping the coupled Jaw from moving in either rotational direction.

To prevent inadvertent dislodging of bolt 40 (i.e., shifting back into its non-locking position), detent pin 36 is urged into V-notch 44, causing bolt 40 to pivot about fulcrum 48. This helps tab 56 to be forcefully maintained in double-locking notch 60, thereby preventing inadvertent rocking and shifting to the right of bolt 40.

Figure 1:
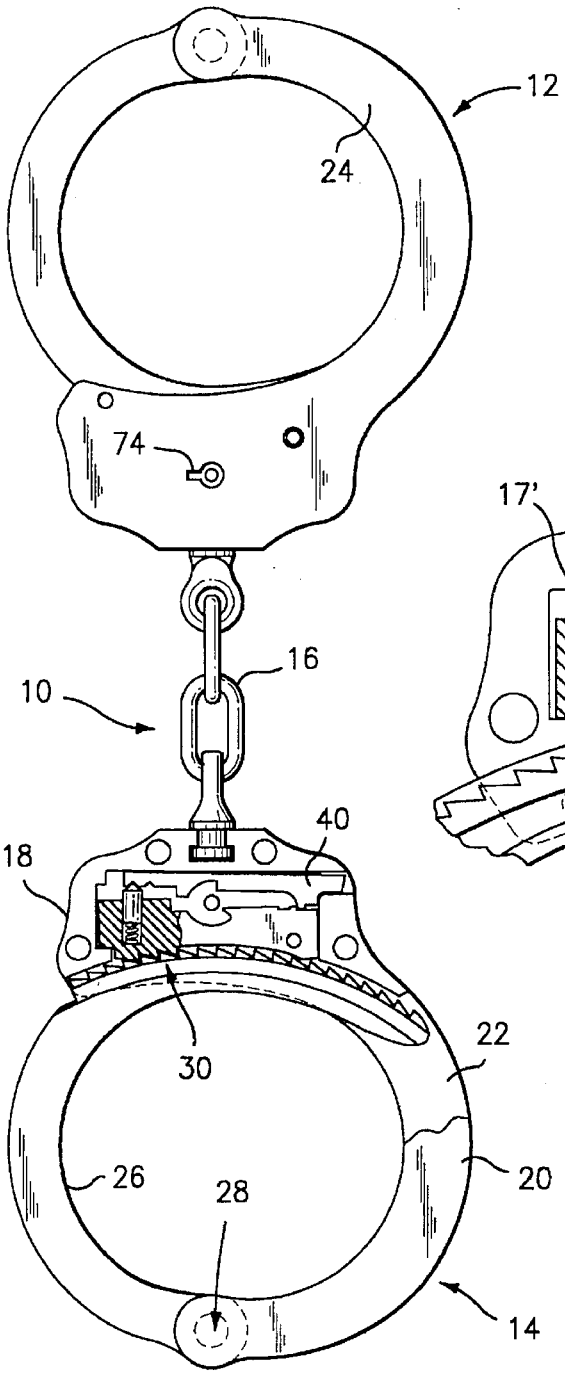
FIG. 1 illustrates a pair of handcuffs, with portions broken away on one cuff to show the preferred embodiment of a "Double-Locking Mechanism" constructed in accordance with the present invention.

To unlock the cuffs, the large end 71 of standard key 72 is placed into keyhole 74, shown in FIG. 1. The key is then pivoted about pin 76 to contact bolt surface 78 (see FIG. 5). This rocks the holt's righthand portion upwardly because surface 78 is located to the right of fulcrum 48. As the bolt rocks, it carries the tab 56 out of double-locking notch 60. Continued pivoting of key end 71 pushes tab 56 over ledge 62 (see FIG. 4) until the tab relocates in non-locking notch 58 (see FIG. 3). Key 72 may then be pivoted about pin 76 in the opposite direction to contact pawl lifting surface 80 and disengage teeth 32 from jaw 34. The jaw can then be withdrawn to release the cuff from the wearer's wrist.

Applicants envision an alternate embodiment of the fulcrum 48 elements. Instead of the bolt top 50 being straight and the casing surface 49 offset, the casing is straight and the bolt angularly offset. The bolt top 50 is sloped, near bolt end 46, away from the casing. Starting at 48, the bolt top 50 levels off and becomes horizontal or parallel to the straight casing surface 49. The operation of this embodiment is the same as that described for FIGS. 3–5.

As used herein, the term "angularly offset" refers to a surface having two substantially straight portions that are inclined relative to one another, wherein the portions meet at a juncture that defines an obtuse angle.

Kindly note that the casing hole or side channel 54 is large enough to accommodate the insertion of even a ball-point pen end (not shown). That enables police to quickly double-lock the cuffs with the handy pen normally carried in their shirt pockets.

It should be understood by those skilled in the art that obvious structural modifications can be made without departing from the spirit or scope of the invention. For example, Applicants' fulcrum means could be created by a pin or bearing between a straight bolt and casing. Also, their double-locking mechanism can be used on leg irons in addition to handcuffs. Accordingly, reference should be made primarily to the accompanying Claims, rather than the foregoing Specification, to determine the scope of the invention.

Having thus described our invention, what is claimed is:

1. In a shackle of the type having a pawl-and-ratchet mechanism that couples a pivotable jaw with a cheek and a slide-bolt assembly, housed at least partially within a lock casing, that selectively double locks the shackle via a pair of bolt notches in a slide bolt to prevent the coupled jaw from pivoting in either direction, the improvement comprising:

a. the slide bolt has a top, bottom, and first and second ends, wherein the top is adjacent an interior surface of the lock casing and the bolt notches are adjacent the bolt's first end;

b. a pair of other, locator notches adjacently located atop a pawl that underlies the bolt, wherein the locator notches are adjacent the bolt's second end and are adapted in size and shape to respectively locate the bolt in either a double-locking position or a non-locking position;

c. a tab on the bottom of the bolt, wherein the tab is adapted in size and shape to selectively rest in either of the locator notches; and d. fulcrum means for selectively pivoting the slide bolt against the casing, lifting the tab from one of the locator notches and sliding the bolt from its non-locking position to its double-locking position, whereupon the tab drops into the other locator notch, wherein the fulcrum means includes a fulcrum with the pair of locator notches being located on one side of the fulcrum and the pair of bolt notches being located on an opposite side of the fulcrum.

2. The shackle of claim 1 wherein the fulcrum means comprises the interior surface of the lock casing having a portion parallel to a horizontal surface of the bolt top and an angularly offset portion that slopes away from the bolt top.

3. The shackle of claim 1 wherein the fulcrum means comprises the bolt top having a horizontal surface portion and an angularly offset portion that slopes away from the interior surface of the lock casing.

4. The shackle of claim 1 wherein the notches are separated by a ledge atop the pawl.

5. The shackle of claim 1 wherein the fulcrum means includes the slide bolt having one end which is inclined and which projects through an opened side channel of a lock casing for the shackle, and further includes a double-lock actuator that can be inserted into the side channel against the inclined bolt end to cause a lifting action of the bolt so that the bolt pivots about the fulcrum against the adjacent surface of the lock casing.

6. The shackle of claim 5 wherein the side channel is adapted in size and shape to accommodate the insertion of a ball-point pen end that acts as the double-lock actuator.

7. The shackle of claim 5 wherein the actuator is a double-locking end of a standard handcuff key.

8. The shackle of claim i wherein the slide bolt has an opposite end portion inside the lock casing, said opposite end portion having two adjacent notches on the bottom of the bolt, and a top of the pawl carries a spring-loaded detent that pushes against one of the notches to provide a spring pressure that cooperates with the fulcrum to press the tab into a locator notch.

9. In a shackle of the type having a pawl-and-ratchet mechanism that couples a pivotable jaw with a cheek and also having a slide-bolt assembly, housed at least partially within a lock casing, that double locks the shackle to prevent the coupled jaw from pivoting in either direction, the improvement comprising:

a. a slide bolt with a substantially straight upper surface adjacent an interior surface of the lock casing;

b. a tab on an underside of the bolt that is adapted in size and shape to selectively sit in either of two locator notches atop the pawl, wherein one of the notches locates the bolt in a maintained non-locking position and the other notch locates the bolt in a maintained double-locking position;

c. an interior surface of the lock casing having a first portion overlying and parallel to a first section of the straight upper surface of the bolt and an angularly offset second portion that overlies and slopes away from a second section Of the holt's straight upper surface, wherein a juncture between the lock casing's first and second surface portions defines a fulcrum; and d. positioning means for pivoting the slide bolt about the fulcrum and moving the tab from one notch to the other.

10. The shackle of claim 9 wherein the notches are separated by a ledge atop the pawl.

11. The shackle of claim 10 wherein the pawl carries a spring-loaded detent pin that pushes against an end portion of the bolt to press the tab into a locator notch.

12. In a shackle of the type having a pawl-and-ratchet mechanism that couples a pivotable jaw with a cheek and also having a slide-bolt assembly, housed at least partially within a lock casing, that selectively double locks the shackle via a pair of bolt notches in a slide bolt to prevent the coupled jaw from pivoting in either direction, the improvement comprising:

a. the slide bolt has a horizontal upper surface portion and an angularly offset upper surface portion, wherein a juncture between the two portions defines a fulcrum;

b. a tab on an underside of the bolt that is adapted in size and shape to selectively sit in either of two locator notches atop the pawl, wherein one of the locator notches locates the bolt in a maintained non-locking position and the other locator notch locates the bolt in a maintained double-locking position;

c. wherein the locator notches are located on one side of the fulcrum and the bolt latches are located on another side of the fulcrum; and d. positioning means for pivoting the slide bolt about its fulcrum and moving the tab from one locator notch to the other.

13. The shackle of claim 12 wherein the notches are separated by a ledge atop the pawl.

14. The shackle of claim 13 wherein the pawl carries a spring-loaded detent pin that pushes against an end portion of the bolt to press the tab into a locator notch.

* * * * *

UNITED STATES PATENT AND TRADEMARK OFFICE

CERTIFICATE OF CORRECTION

PATENT NO. : 5,660,064
DATED : August 26, 1997
INVENTOR(S) : Ecker et al

It is certified that error appears in the above-indentified patent and that said Letters Patent is hereby corrected as shown below:

Column 3, line 61, change "holt's" to --bolt's --.

Column 4, line 41, change "Jaw" to --jaw--.

Column 4, line 51, change "holt's to --bolt's --.

Column 5, line 8, change "pen" to --pens--.

In Claim 8, column 6, line 3, change "i" to --l--.

In Claim 9, column 6, line 29, change "Of" to --of--.

In Claim 12, column 6, line 56, change "latches" to --notches--.

Signed and Sealed this

Eleventh Day of November, 1997

*Attest:*

*Attesting Officer*

Bruce Lehman

BRUCE LEHMAN

*Commissioner of Patents and Trademarks*